US012251055B2

(12) United States Patent
Kling

(10) Patent No.: US 12,251,055 B2
(45) Date of Patent: Mar. 18, 2025

(54) TISSUE REFILL FOR TISSUE RECOVERY

(71) Applicant: Essity Hygiene and Health Aktiebolag, Gothenburg (SE)

(72) Inventor: Robert Kling, Gothenburg (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 547 days.

(21) Appl. No.: 17/312,565

(22) PCT Filed: Dec. 21, 2018

(86) PCT No.: PCT/EP2018/086728
§ 371 (c)(1),
(2) Date: Jun. 10, 2021

(87) PCT Pub. No.: WO2020/126048
PCT Pub. Date: Jun. 25, 2020

(65) Prior Publication Data
US 2022/0053982 A1 Feb. 24, 2022

(51) Int. Cl.
*A47K 10/20* (2006.01)
*A47K 10/36* (2006.01)

(52) U.S. Cl.
CPC ..... *A47K 10/20* (2013.01); *A47K 10/3643* (2013.01)

(58) Field of Classification Search
CPC ..... A47K 10/20
See application file for complete search history.

(56) References Cited

U.S. PATENT DOCUMENTS 4,648,510 A * 3/1987 Kuenzel ..... C11D 17/046 510/513
5,853,547 A 12/1998 Ahrens et al.
5,930,876 A 8/1999 Takizawa et al.
6,286,712 B1 9/2001 Craig et al.
7,527,709 B2 5/2009 Lippi et al.
7,550,061 B2 6/2009 Walkenhaus et al.
(Continued)

FOREIGN PATENT DOCUMENTS

AU 2011373054 A1 1/2014
CN 1166950 A 12/1997
(Continued)

OTHER PUBLICATIONS

Office Action issued on Mar. 3, 2022, by the Federal Service for Intellectual Property in Russian Patent Application No. 2021119754/03(041564) and an English Translation of the Office Action. (18 pages).

(Continued)

*Primary Examiner* — Gene O Crawford
*Assistant Examiner* — Ayodeji T Ojofeitimi
(74) *Attorney, Agent, or Firm* — Buchanan Ingersoll & Rooney PC

(57) ABSTRACT

A tissue paper refill for a tissue paper dispenser. The refill includes a web of tissue paper having a leading end and a trailing end for engagement with the trailing end and leading end respectively of a previous and subsequent refill. The web is provided with a mechanical connector at one or both of its ends to realize such engagement. The mechanical connector is water soluble for the purpose of tissue recovery. Also, a method of tissue recovery.

20 Claims, 5 Drawing Sheets

(56) References Cited

U.S. PATENT DOCUMENTS

| | | | |
|---|---|---|---|
| 7,744,726 | B2 | 6/2010 | Scherb et al. |
| 8,789,787 | B2 | 7/2014 | Kling et al. |
| 9,668,621 | B2 | 6/2017 | Andersson et al. |
| 10,413,136 | B2 | 9/2019 | Larsson |
| 2004/0157036 | A1 | 8/2004 | Provost et al. |
| 2005/0196581 | A1 | 9/2005 | Provost et al. |
| 2006/0289557 | A1 | 12/2006 | Mitchell et al. |
| 2007/0215304 | A1 | 9/2007 | Lippi Alves Fernandes et al. |
| 2007/0272701 | A1 | 11/2007 | Carlsson et al. |
| 2011/0031263 | A1* | 2/2011 | Carrier ..... B65D 83/0894 221/45 |
| 2013/0313279 | A1 | 11/2013 | Sudworth et al. |
| 2014/0134376 | A1 | 5/2014 | Larsson |
| 2014/0291186 | A1 | 10/2014 | Andersson et al. |
| 2014/0326620 | A1* | 11/2014 | Mir ..... A01N 25/06 504/357 |
| 2015/0014472 | A1 | 1/2015 | Hussain |
| 2016/0120377 | A1 | 5/2016 | Larsson et al. |
| 2016/0340068 | A1* | 11/2016 | Brandt Sanz ..... C11D 17/042 |
| 2018/0354667 | A1 | 12/2018 | Wallenius et al. |
| 2022/0053982 | A1 | 2/2022 | Kling |

FOREIGN PATENT DOCUMENTS

| | | | |
|---|---|---|---|
| CN | 1753630 | A | 3/2006 |
| CN | 1929769 | A | 3/2007 |
| CN | 101325899 | A | 12/2008 |
| CN | 104870347 | A | 8/2015 |
| CN | 105263381 | A | 1/2016 |
| CN | 106455764 | A | 2/2017 |
| CN | 106470583 | A | 3/2017 |
| CN | 107614385 | A | 1/2018 |
| CN | 207988066 | U | 10/2018 |
| EP | 0809951 | A2 | 12/1997 |
| EP | 0809952 | B1 | 9/2001 |
| EP | 1156925 | B1 | 4/2006 |
| RU | 2557775 | C1 | 7/2015 |
| RU | 2014105291 | A | 8/2015 |
| WO | 2005087068 | A1 | 9/2005 |
| WO | 103261050 | A | 8/2013 |
| WO | 2014098666 | A | 6/2014 |
| WO | 2014098669 | A1 | 6/2014 |
| WO | 2015195017 | A1 | 12/2015 |
| WO | 2020126048 | A1 | 6/2020 |

OTHER PUBLICATIONS

Office Action (Decision of Rejection) issued Jan. 11, 2023, by the National Intellectual Property Administration, P. R. China in corresponding Chinese Patent Application No. 201880100392.5 and an English translation of the Office Action. (14 pages).

Office Action (Examination Report No. 1) issued on May 31, 2022, by the Australian Patent Office in corresponding Australian Patent Application No. 2018454419. (3 pages).

Office Action (Notification of the First Office Action) issued on Mar. 10, 2022 by the China National Intellectual Property Administration (CNIPA) of the People's Republic of China in corresponding Chinese Patent Application No. 2018800100392.5, and an English Translation of the Office Action. (21 pages).

Office Action (Patent Examination Report No. 1) issued on Apr. 14, 2023, in corresponding New Zealand Patent Application No. 777410. (4 pages).

Office Action issued on Mar. 9, 2023, in corresponding Colombian Patent Application No. NC2021/0007961. (11 pages).

International Search Report (PCT/ISA/210) and Written Opinion (PCT/ISA/237) mailed on Aug. 26, 2019, by the European Patent Office as the International Searching Authority for International Application No. PCT/EP2018/086728.

Office Action (Examination Report No. 2) issued on Jul. 12, 2022, by the Australian Patent Office in corresponding Australian Patent Application No. 2018454419. (7 pages).

Office Action (Notification of the Second Office Action) issued on Sep. 2, 2022, by the Chinese Patent Office in corresponding Chinese Patent Application No. 201880100392.5, and an English Translation of the Office Action. (21 pages).

Office Action/Examination Search Report issued on Jun. 8, 2023, in corresponding Canadian Patent Application No. 3,124,469. (3 pages).

Office Action issued on Dec. 28, 2023, in corresponding Colombian Patent Application No. NC2021/0007961. (10 pages).

* cited by examiner

TISSUE REFILL FOR TISSUE RECOVERY

TECHNICAL FIELD

The present invention relates to paper tissues and in particular to tissue paper refills for use in tissue dispensers. The invention further relates to recovery of tissues for recycling purposes.

BACKGROUND

Tissue paper is used in many contexts, including as napkins, toilet paper, face tissues, kitchen towels and as hand towels. The type of tissue and the manner of dispensing varies according to the intended use and the environment of use. For commercial locations and public places high volume dispensers may be required. This is particularly the case for hand towel dispensers which may dispense hand towels from refills in the form of bundles forming stacks or rolls. Certain dispensers allow multiple bundles to be inserted and provide a form of connection between the start of a new bundle and the trailing edge of the previous bundle. These may be referred to as multi-refill tissue dispensers in that they are capable of containing more than one refill at a time. One such dispensing arrangement is shown in WO2015/195017, the contents of which are incorporated herein by reference in their entirety.

In some situations, the volume and condition of used tissue paper may make tissue recovery both desirable and possible. In the present context, "recovery" is the collection of paper for use in the manufacture of recycled paper or some other product. Recovery may sometimes be desirable for used hand towels in cases where the used towels have remained largely uncontaminated by other sources of waste. In cases where recovery is intended, it is important that the tissue paper is largely uncontaminated with items other than paper, which could interfere with the recycling process. The same may also apply even if other forms of disposal are intended. It would be desirable to improve the process of supply, dispensing, use and recovery of tissues in order to ensure an end product that is better suited for subsequent recycling or disposal.

SUMMARY

According to an embodiment of the present disclosure, a tissue paper refill for a tissue paper dispenser is disclosed. The refill comprises a web of tissue paper having a leading end and a trailing end for engagement with the trailing end and leading end respectively of a previous and subsequent refill, the web being provided with a mechanical connector at one or both of its ends to realise such engagement. The mechanical connector is water soluble for the purpose of tissue recovery. The refill is particularly applicable to multi-refill tissue dispensers that are capable of receiving a plurality of such refills at the same time.

The mechanical connector may be any suitable mechanical connector that can be used in a tissue context. It should be adequately strong to ensure that the tissue web of a subsequent refill is guided through the dispenser without becoming detached. It will be understood that this requires not only sufficient strength in the connector itself but also a resistance to entanglement with other surfaces or mechanisms within the dispenser that might interfere with operation. It will also be understood that the mechanical connector may be a one part connector provided on one end of the web only or a two part connector with complementary mating portions provided on each of the ends.

One well-known form of mechanical connector that has proven suitable for use in a tissue context is the hook and/or loop type connecter. Various configurations of such connector are known, including microhooks, hook to hook, intermixed hook and loop and the like. In certain cases, only hooks may be required at one end of the web if such hooks are capable of engaging with the web material. Reference to a hook and/or loop connector is intended to cover all of the variations and permutations of these concepts. In one embodiment, there may be provided a hook type connector at a trailing end and a loop type connector at a leading end or vice-versa.

The mechanical connector may comprise a water soluble polymer that achieves the required level of solubility for tissue recovery purposes. One exemplary material is polyvinyl alcohol (sometimes abbreviated to PVA or PVOH), which is soluble in water over a range of temperatures. The skilled person will choose the degree of hydrolysis and molecular weight according to the solubility and other properties required.

As indicated above, the mechanical connector should be water soluble for the purpose of tissue recovery. In the present context, this is intended to denote that the solubility should be sufficient to allow the connector to substantially dissolve during typical processing of the tissue in a recovery process, preferably without additional process steps or conditions being required. Such processing typically comprises soaking in water or an aqueous solution for a period of time sufficient to soften the tissue to a pulp. The time and temperature may be sufficient to ensure deactivation or decontamination of the tissue. Under these conditions, the connector should also be substantially dissolved i.e. dissolved completely or to such a degree that it can be accepted into a further recycle step. In a preferred form, the material of the mechanical connector is substantially dissolved after a period of 25 minutes at a temperature of less than 90 C, preferably less than 70 C. In an ideal case, the process may last less than 25 minutes at less than 65 C.

The mechanical connector may be provided on the web in any convenient manner. It is not excluded that in some forms the mechanical connector may be integrated into the tissue material during manufacture of either the web or the connector. Alternatively, it may be welded thereon e.g. by heat and/or pressure. In one embodiment, the mechanical connector is attached to the web by a water soluble adhesive.

The refill may be in various forms including rolls and stacks. In one embodiment the refill is in the form of a stack and the web comprises folded tissues. The web may be continuous, separated by perforations into sheets or comprise separate sheets interfolded together in V, M or Z configuration. In the present context, reference to a web may include both a single web, a double web or even a multi-web, each of which may comprise one or more plies of tissue material.

The refill according to any one of the preceding claims, wherein the mechanical connector comprises first type connector elements and second type connector elements positioned in a symmetrical pattern, preferably a chequer pattern, at the leading end and/or trailing end such that correct engagement with the trailing end of a previous refill can take place irrespective of the angular orientation of the refill. One manner in which such symmetrical placement may be achieved is to provide both male and female i.e. both hook and loop type connection elements at both the leading and trailing ends and to arrange the respective elements in rotationally symmetrical quadrants on the engaging ends. Such an arrangement is as disclosed in WO2015/195017, referenced above.

The tissue paper may comprise any suitable tissue for its intended purpose. The term "tissue" is herein to be understood as a soft absorbent paper having a basis weight below 65 g/m2, and typically between 10 g/m2 and 50 g/m2. Its uncompressed density is typically below 0.30 g/cm3, preferably between 0.08 and 0.20 g/cm3. The fibres contained in the tissue are mainly pulp fibres from chemical pulp, mechanical pulp, thermo-mechanical pulp, chemo-mechanical pulp and/or chemo-thermo-mechanical pulp (CTMP). The tissue may also contain other types of fibres enhancing, e.g., strength, absorption or softness of the paper. The tissue may include recycled or virgin fibres or a combination thereof.

The tissue paper may comprise a wet crepe material, a dry crepe material, a structured tissue material, or a combination of at least a dry crepe material and at least a structured tissue material. A structured tissue material is a three-dimensionally structured tissue paper web. The structured tissue material may be a TAD (Through-Air-Dried) material, a UCTAD (Uncreped-Through-Air-Dried) material, an ATMOS (Advanced-Tissue-Molding-System), an NTT material (New Tissue Technology from Valmet Technologies) or a combination of any of these materials. A combination material is a tissue material comprising at least two plies, where one ply is of a first material, and the second ply is of a second material, different from said first material.

Optionally, the tissue paper may comprise hybrid tissue. In the present disclosure, this is defined as a combination material comprising at least one ply of a structured tissue material and at least one ply of a dry crepe material. Preferably, the ply of a structured tissue material may be a ply of TAD material or an ATMOS material. In particular, the combination may consist of structured tissue material and dry crepe material, preferably consist of one ply of a structured tissue paper material and one ply of a dry crepe material, for example the combination may consist of one ply of TAD or ATMOS material and one ply of dry crepe material. An example of TAD is known from U.S. Pat. No. 5,5853,547; ATMOS from U.S. Pat. Nos. 7,744,726, 7,550,061 and 7,527,709; and UCTAD from EP 1 156 925.

The refill may be provided in a compressed state. Tissue paper is a rather bulky commodity and the degree of compression has a significant influence on transportation logistics and cost. In particular, for high-volume dispensing situations, a high-density compressed refill may be desirable. In an embodiment, the refill has a density prior to use of greater than 0.2 g/cm3, optionally greater than 0.25 g/cm3 and even greater than 0.3 g/cm3.

The refill may also be wrapped prior to use e.g. in a wrapper of high tensile paper, in order to maintain the desired degree of compression. Removal of the wrapper may expose at least the mechanical connector at the leading end of the refill.

Embodiments of the invention also relate to a method of tissue recovery for used tissues from multi-refill tissue paper dispensers in the case that at least some of the tissues comprise water soluble mechanical connectors for joining the tissue paper of a first refill with the tissue paper of a second refill. The method may comprise collecting the used tissues, including the water soluble mechanical connectors, in a dedicated recipient and soaking the tissues in water or an aqueous medium for a period of time and at a temperature sufficient to dissolve the mechanical connectors.

As indicated above, the tissues may be soaked for less than 60 minutes, preferably less than 40 minutes and more preferably less than 30 minutes and soaking may take place at a temperature of less than 100 C, preferably less than 80 C and more preferably less than 70 C. The tissues may subsequently be provided as feedstock for the manufacture of recycled paper or may be otherwise disposed of e.g. by composting or the like.

The method may further comprise, prior to collection: installing a first tissue paper refill in a multi-refill tissue paper dispenser; providing a second tissue paper refill; joining the tissue paper of the first refill with the tissue paper of the second refill by means of a water soluble mechanical connector; and subsequently dispensing the tissue. Once the first refill has been fully dispensed, the second refill may be dispensed without interruption. The trailing end of the first refill may, through the mechanical connector, cause the leading end of the second refill to present itself to a user. The portion or portions of the tissue paper web on which the mechanical connector is disposed may be unsuitable for use as a tissue and may be discarded directly. It will be understood that in a public environment, this disposal is likely to take place into the same recipient as the discarded tissue. The water soluble nature of the mechanical connector ensures that recovery of the discarded tissue is not hereby impeded, since the material of the mechanical connector will not deteriorate or otherwise contaminate the collected tissue.

BRIEF DESCRIPTION OF THE DRAWINGS

The present invention will be discussed in more detail below, with reference to the attached drawings of certain exemplary embodiments, in which.

DETAILED DESCRIPTION

Figure 1:
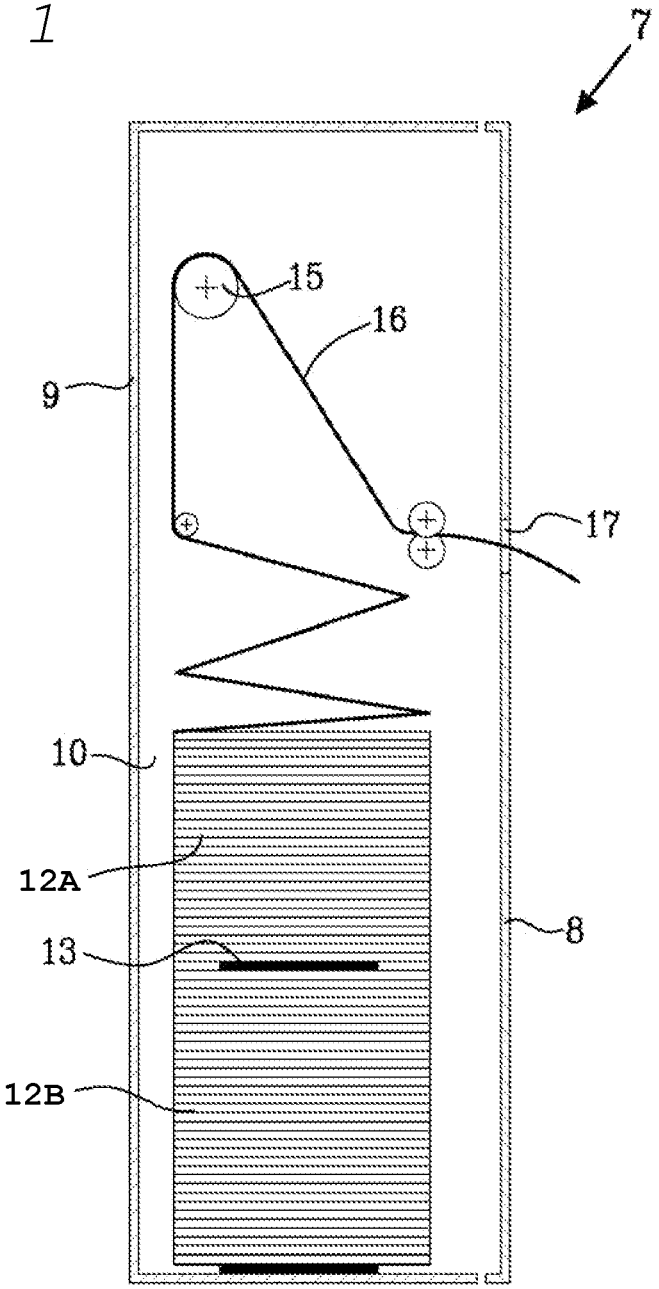
FIG. 1 depicts a schematic cross-section through a multi-refill tissue paper dispenser.

FIG. 1 shows schematically an example of a multi-refill tissue paper dispenser 7 for storage and dispensing of tissue material. The dispenser 7 has a front panel 8, a body 9 and an interior space 10. The interior space 10 is intended for holding a number of refills 12A, 12B of tissue paper in the form of a tissue paper web 16. An opening 17 is provided in the front panel 8 by which the web 16 can be dispensed to a user. The web 16 is guided from the refill 12A to the opening 17 via a number of guiding rollers 15 as is conventional in the art. In the illustrated embodiment, the web 16 is withdrawn and tissue is dispensed from the top of the refill 12A. It is however understood that the invention is also applicable to other configurations including ones in which the tissue is withdrawn from the bottom of the dispenser.

The first refill 12A and the second refill 12B are joined together by a mechanical connection 13 whereby the web 16 is continuous between the first refill 12A and the second refill 12B. In the illustrated embodiment, the refills 12A, 12B are in the form of stacks of folded tissue paper and the web 16 actually comprises two interfolded sub-webs, each of 2-ply dry-crepe tissue according to the Essity article number 140299, each of the plies being 18 gsm. The skilled person will nevertheless understand that any other suitable tissue may be used. In the illustrated example, the webs are interfolded together in a Z-fold configuration as further discussed below. The mechanical connector 13 comprises a hook and loop fastener of PVA material.

Figure 2:
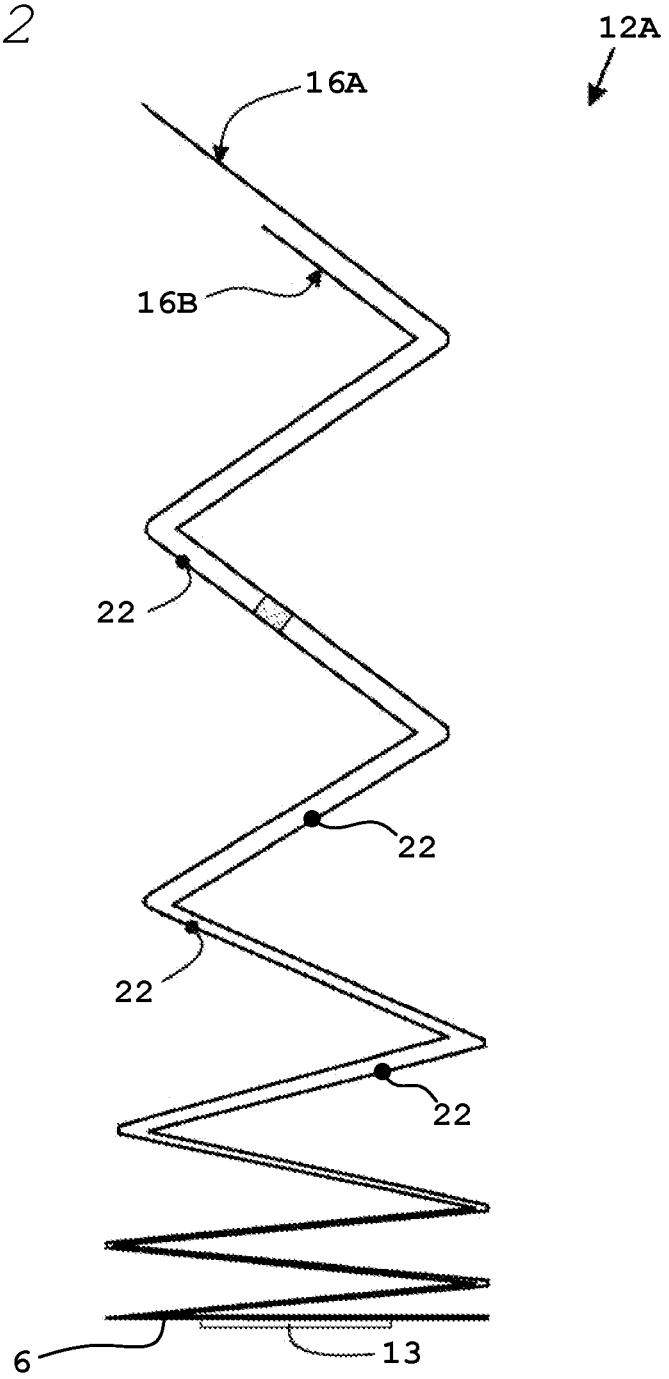
FIG. 2 depicts a schematic view of part of a tissue refill shown in FIG. 1.

FIG. 2 schematically shows part of the first refill 12A of FIG. 1 in greater detail, illustrating the interfolding of the sub-webs 16A, 16B. Each of the sub-webs 16A, 16B is divided into individual tissues 20 at perforations 22, whereby each tissue 20 is twice folded to have a Z-fold configuration. The perforations 22 in the sub-webs 16A, 16B are offset from each other by at least one fold such that the web 16 can be drawn continuously through the opening 17 without risk of breakage. A mechanical connection 13 is provided at a trailing end 6 of the refill 12A.

Figure 3:
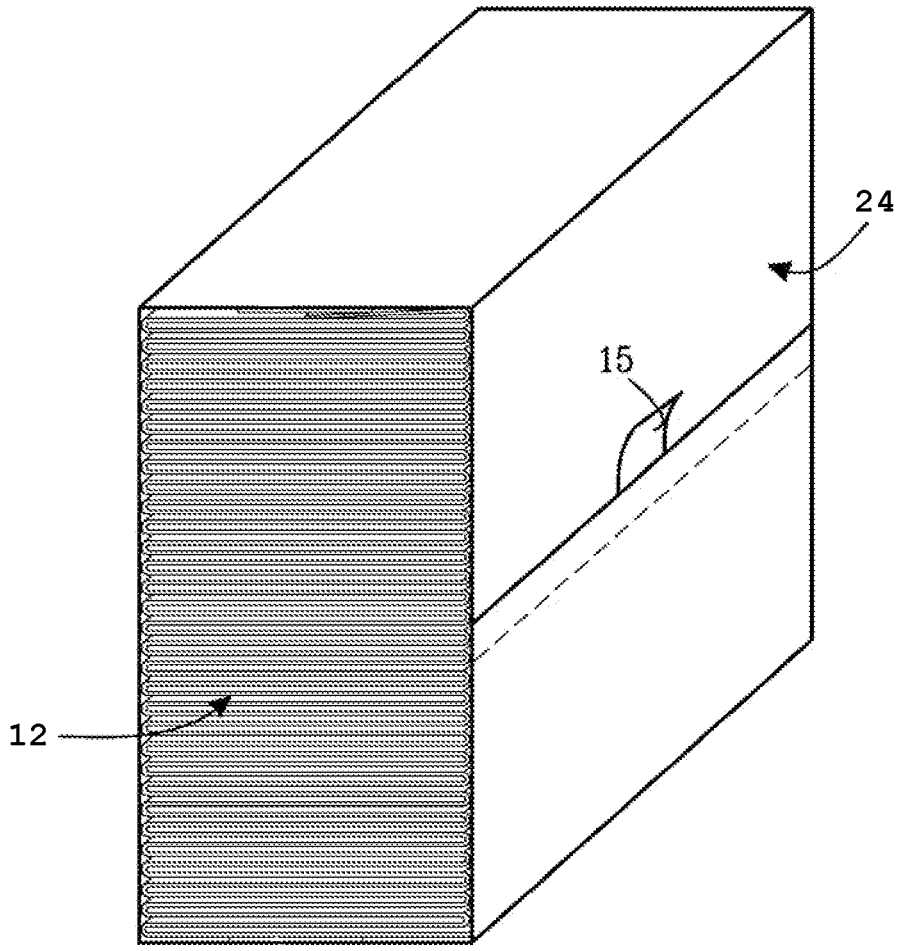
FIG. 3 depicts a tissue refill prior to use in wrapped condition.

FIG. 3 shows a refill 12 in perspective view prior to use, wrapped in a wrapper 24 of high-tensile bander paper. In this context, high-tensile is intended to denote that the bander paper is of sufficient strength to maintain the refill in a compressed condition for ease of storage and transport. When it is desired to use the refill 12, the wrapper 24 may be removed by opening at the tab 15.

Figure 4:
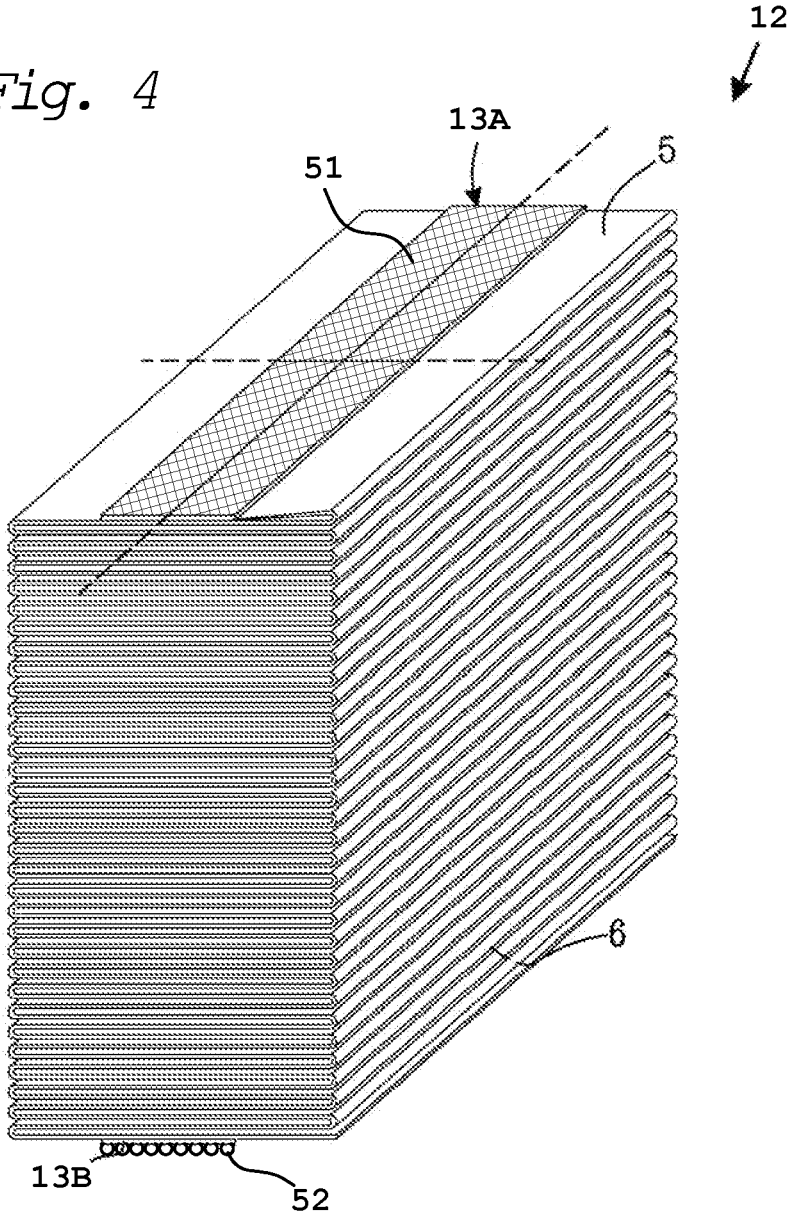
FIG. 4 depicts the tissue refill of FIG. 3 unwrapped.

FIG. 4 shows a refill 12 in perspective view with the wrapper 24 removed, showing the mechanical connection 13A at a leading end 5 of the refill 12. A complimentary mechanical connection 13B is provided at the trailing end 6 of the refill 12. The mechanical connection 13A comprises hook type connection elements 51 and the complimentary mechanical connection 13B comprises loop type connection elements 52.

Operation of the multi-refill tissue paper dispenser 7 for dispensing of tissues 20 will now be explained with reference to FIGS. 1 to 4. In use, users withdraw tissues 20 through the opening 17. Used tissues 20 will be deposited in an appropriate collection container (not shown). As the first refill 12A is depleted, a mechanical connection 13 will eventually be withdrawn around the guiding rollers 15 and through the opening 17. This will also be discarded in the collection container and users will withdraw subsequent tissues from the second refill 12B. Periodically service personnel will open the front panel to determine the degree of filling of the interior space 10. If there is adequate space for introduction of an additional refill 12, then the service personnel will remove the wrapper 24 from the additional refill 12, lift the second or lowermost refill 12B and insert the additional refill 12 into the interior space 10 below the second refill 12B. The hook type connection elements 51 at the leading end 5 of the additional refill 12 and the loop type connection elements 52 at the trailing end 6 of the second refill 12B will engage together such that the web 16 is continuous between these refills. Dispensing of tissues 20 may then continue.

The service personnel will also collect the container of used and discarded tissues, which will be transported to a tissue recovery facility. In a prophetic example, the collected tissues 20, including mechanical connections 13 are soaked in water for a period of 25 minutes and at a temperature of 65 C with gentle agitation. After the soaking period the pulp is examined for remnants of the mechanical connections 13 and it is observed that no discernible traces can be found. The pulp is deemed suitable for further recycling.

Figure 5:
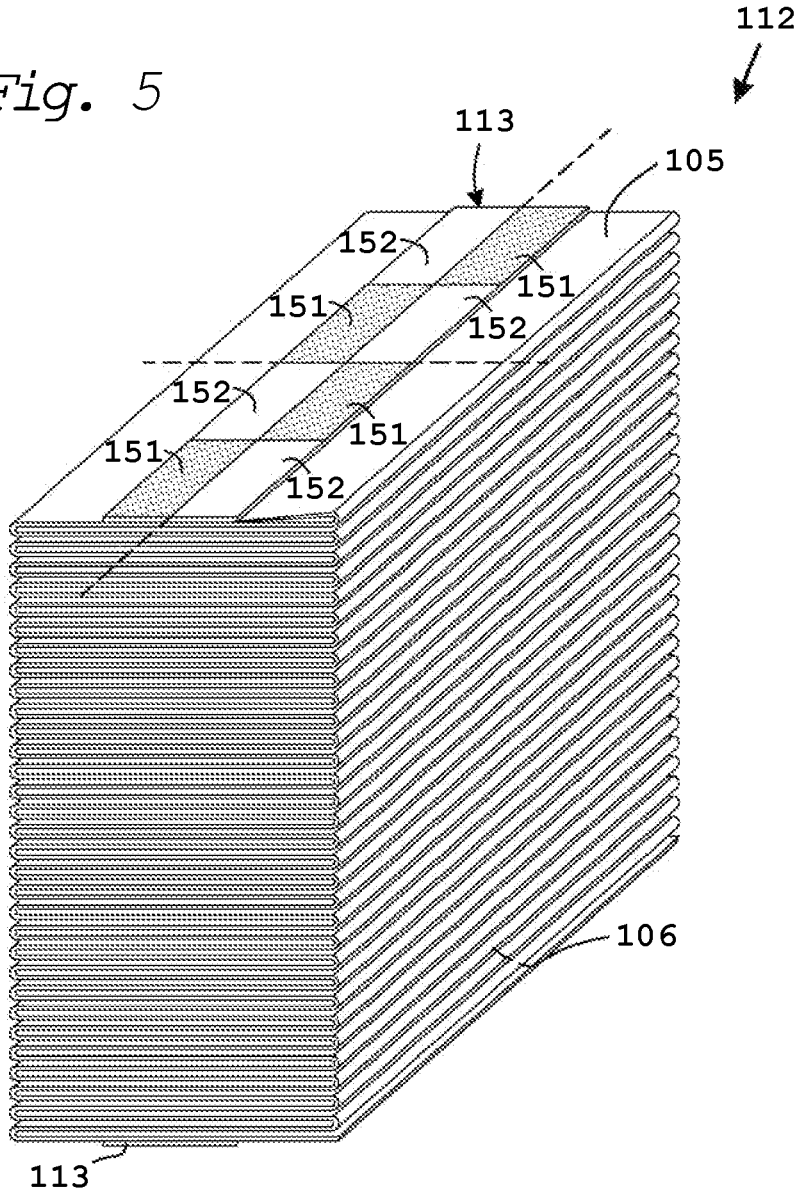
FIG. 5 depicts an alternative tissue refill.

FIG. 5 shows an alternative refill 112 in perspective view, showing a different form of mechanical connection 113 at a leading end 105 of the refill 112. An otherwise identical mechanical connection 113 is provided at the trailing end 106 of the refill 112. In this embodiment, the mechanical connection 113 comprises both hook type connection elements 151 and loop type connection elements 152 arranged in a rotationally symmetrical manner on the leading end 105 of the refill 112. Because of the symmetrical configuration of the mechanical connections 113, when service personnel wish to install an additional refill, there is no need for it to be oriented in any particular direction. The hook type connection elements 151 on the leading end 105 of the additional refill 112 will always align with the loop type connection elements 152 at the trailing end 106 of the second refill 112B and vice-versa.

The invention has been described by reference to certain embodiments discussed above. It will be recognized that these embodiments are susceptible to various modifications and alternative forms well known to those of skill in the art. In particular, although a dispenser for stacked folded tissues has been shown, it will be understood that other forms of dispenser for tissues may also benefit from the use of water soluble mechanical connections. Furthermore, although a symmetrical arrangement of hook and loop fastening elements has been described, other alternative mechanical connections may be used in different configurations.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A tissue paper refill for a tissue paper dispenser, the refill comprising a web of tissue paper, having a leading end and a trailing end for engagement with the trailing end and leading end respectively of a previous and subsequent refill, the web being provided with a mechanical connector at one or both of its ends to realise such engagement, the mechanical connector being water soluble for the purpose of tissue recovery.

2. The refill according to claim 1, wherein the mechanical connector comprises a hook and/or loop type connection.

3. The refill according to claim 1, wherein the mechanical connector comprises a hook type connector at a trailing end and a loop type connector at a leading end or vice-versa.

4. The refill according to claim 1, wherein the mechanical connector comprises first type connector elements and second type connector elements positioned in a symmetrical pattern at the leading end and/or trailing end such that correct engagement with the trailing end of a previous refill can take place irrespective of the angular orientation of the refill.

5. The refill according to claim 1, wherein the mechanical connector comprises a water soluble polymer.

6. The refill according to claim 5, wherein the connector is configured to be fully dissolved in water after a period of 25 minutes at a temperature of less than 90° C.

7. The refill according to claim 1, wherein the refill is in the form of a stack and the web comprises folded tissues.

8. The refill according to claim 1, wherein the mechanical connector is attached to the web by a water soluble adhesive.

9. The refill according to claim 1, wherein the tissue paper comprises structured tissue, or hybrid tissue or dry crepe tissue.

10. The refill according to claim 1, wherein the refill has density prior to use of greater than 0.2 $g/cm^3$.

11. The refill according to claim 1, wherein the refill is wrapped prior to use in a wrapper and removal of the wrapper exposes at least the mechanical connector at the leading end.

12. A plurality of tissue paper refills, each refill comprising a web of tissue paper, having a leading end and a trailing end, wherein the trailing end of a first refill is connected to the leading end of a second refill by a mechanical connector, the mechanical connector being water soluble for the purpose of tissue recovery.

13. The refill according to claim 2, wherein the refill is in the form of a stack and the web comprises folded tissues, wherein the stack has a leading end mechanical connector on a top side of the stack and has a trailing end mechanical connector on a bottom side, to realize engagement with a previous and subsequent refill, wherein the refill is wrapped prior to use in a wrapper and removal of the wrapper exposes at least the mechanical connector at the leading end, wherein the wrapped refill has a density of greater than 0.2 $g/cm^3$.

14. The refill according to claim 13, wherein each of the leading end mechanical connector and the trailing end mechanical connector comprise first type connector elements and second type connector elements positioned in a symmetrical pattern, such that correct engagement with the trailing end of a previous refill can take place irrespective of the angular orientation of the refill.

15. A method of tissue recovery for used tissues from multi-refill tissue paper dispensers, comprising water soluble mechanical connectors for joining the tissue paper of a first refill with the tissue paper of a second refill, the method comprising:

a. collecting the used tissues, including the water soluble mechanical connectors, in a dedicated recipient;

b. soaking the tissues in water or an aqueous medium for a period of time and at a temperature sufficient to dissolve the mechanical connectors.

16. The method according to claim 15, wherein the tissues are soaked for less than 60 minutes.

17. The method according to claim 15, wherein the tissues are soaked at a temperature of less than 100° C.

18. The method according to claim 15, wherein the tissues are subsequently provided as feedstock for the manufacture of recycled paper.

19. The method according to claim 15, further comprising, prior to step a:

installing a first tissue paper refill in a multi-refill tissue paper dispenser; providing a second tissue paper refill;

joining the tissue paper of the first refill with the tissue paper of the second refill by means of a water soluble mechanical connector; and dispensing the tissue.

20. The method according to claim 15, wherein the refills comprise a web of tissue paper, having a leading end and a trailing end for engagement with the trailing end and leading end respectively of a previous and subsequent refill, the web being provided with a mechanical connector at one or both of its ends to realize such engagement, the mechanical connector being water soluble for the purpose of tissue recovery.

* * * * *